US005146862A

United States Patent [19]

Sato et al.

[11] Patent Number: 5,146,862

[45] Date of Patent: Sep. 15, 1992

[54] SEWING MACHINE-DRIVING APPARATUS

[75] Inventors: Tadashi Sato, Hirakata; Masaharu Imanishi, Sanda; Katsuhiko Iwai, Kawanishi, all of Japan

[73] Assignees: Matsushita Electric Industrial Co., Ltd., Kadoma; Yamato Mishin Seizo Kabushiki Kaisha, Toyonaka, both of Japan

[21] Appl. No.: 727,849

[22] Filed: Jul. 9, 1991

[30] Foreign Application Priority Data

Jul. 16, 1990 [JP] Japan ..... 2-189123

[51] Int. Cl.[5] ..... D05B 69/18; D05B 69/22

[52] U.S. Cl. ..... 112/275; 112/300; 112/163

[58] Field of Search ..... 112/275, 300, 163, 165, 112/167, 197, 199, 200, 201, 202, 220, 221

[56] References Cited

U.S. PATENT DOCUMENTS 4,955,306 9/1990 Sato et al. ..... 112/300 X 5,018,466 5/1991 Hasegawa ..... 112/275

*Primary Examiner*—Peter Nerbun

*Attorney, Agent, or Firm*—Cushman, Darby & Cushman

[57] ABSTRACT

A sewing machine-driving apparatus forms an accurate and stable seam at a first stitch in a conventional double chain stitch or covering chain stitch sewing machine. Its motor is controlled so as to drive the sewing machine in a direction reverse to that of the usual sewing operation for a limited time period between the completion of a thread cutting operation and a point of time when the sewing machine needles reach their needle-down position. Thus, the stitching needles reach their lowest points without scooping a looper thread at the first stitch; assuring the formation of a stable and accurate seam in the second stitch.

6 Claims, 10 Drawing Sheets

FIG.9 (A) (PRIOR ART)
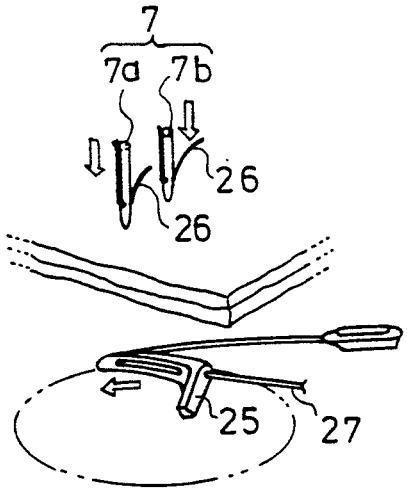
FIG.9 (B) (PRIOR ART)
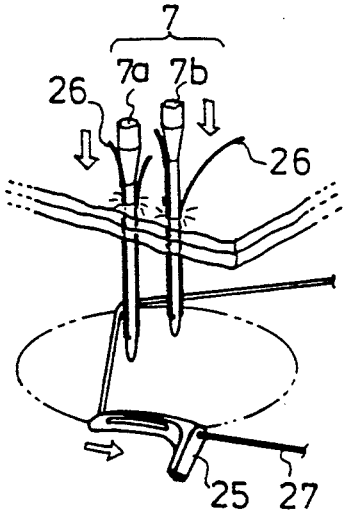
FIG.9 (C) (PRIOR ART)
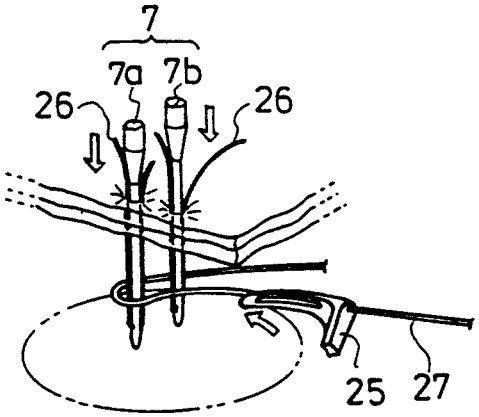
FIG.9 (D) (PRIOR ART)
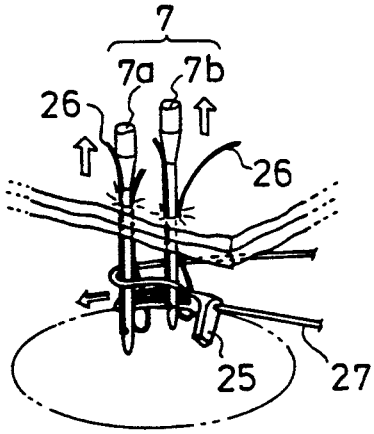
FIG.9 (E) (PRIOR ART)
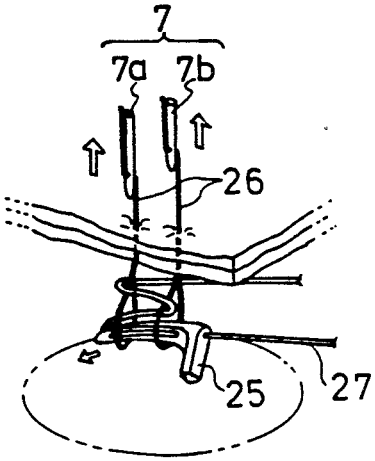
FIG.9 (F) (PRIOR ART)
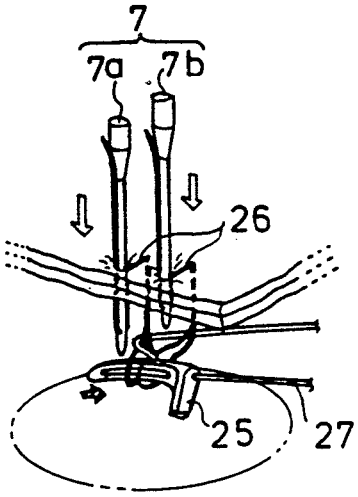

SEWING MACHINE-DRIVING APPARATUS

FIELD OF THE INVENTION AND THE RELATED ART STATEMENT

1. Field of the Invention

The present invention generally relates to a sewing machine-driving apparatus and, in particular, it is concerned with a sewing machine-driving apparatus which permits a process for forming a double chain stitch seam or a covering chain stitch seam by a double chain stitch sewing machine or a covering chain stitch sewing machine. More particularly, it is concerned with a sewing machine-driving apparatus capable of forming a first seam at an end of cloth in the above-stated process.

2. Description of the Prior Art

In the conventional method for driving the double chain stitch sewing machine or the covering chain stitch sewing machine using two or more needles, it is generally well known to control the sewing machine to stop so that its position of stoppage may coincide with a predetermined position, i.e. a needle-up position or a needle-down position.

However, a technology relating to a sewing machine-driving apparatus as will be disclosed by the present invention has not heretofore been known. According to the present invention, the first seam can be made uniform by driving the sewing machine in a rotational direction reverse to that of the usual sewing operation during a time period starting from the needle-up position and ending with the needle-down position of the first stitch of the sewing start.

In the following paragraphs, an explanation will be made with reference to the appended drawings to a manner of forming a starting stitching seam in the above-stated conventional driving apparatus for the double chain stitch sewing machine or the covering chain stitch sewing machine using two or more needles.

FIG. 4 is a schematic view showing an arrangement generally employed for a conventional sewing machine-driving apparatus together with the sewing machine itself, and FIG. 5 shows a block diagram of the sewing machine-driving apparatus of FIG. 4.

As shown by FIG. 4, the sewing machine 1, having a position detection device 6, is driven by a motor 3 through a belt 2. The operator carriers out a stitching operation by operating a pedal 5 with his or her foot to actuate a control device 28 for controlling the motor 3 which drives or stops the sewing machine 1. As shown in FIG. 5, the operation of the pedal 5 is sensed by a pedal sensor 8. Pedal sensor 8 generates a driving command 9 when operator steps down on the pedal 5 by his or her toe and generates a thread-cutting command 10 when the operator returns the pedal 5 back by his or her heel. The driving command 9 is fed to a speed control unit 12 which rotates the motor 3 to drive the sewing machine 1 at a speed which corresponds to the driving command 9. When the pedal 5 is returned to a neutral position, the driving command 9 in interrupted. When the driving command 9 is interrupted, the position control unit 14 issues a command to the speed control unit 12 for stopping the motor 3 to the speed control unit 12 so that it may stop at a position which is being perceived by the needle position detection device 6, and the needles stop at a predetermined position.

After, driving the sewing machine 1 to complete the stitching operation, stopping it at the predetermined position and then stepping the pedal 5 back to the heel side to issue a thread cutting command 10 (as previously described), a thread cutting operation control unit 15 starts to energize an electromagnetic solenoid or a known air valve (omitted from the illustration), which is included in a thread cutter mechanism 16 of the sewing machine 1 to carry out the thread cutting operation in compliance with a predetermined sequence.

The foregoings are the exemplified arrangements employed in the generally well known micro-computer-implemented sewing machine-driving apparatus.

Next, a detailed known procedure for forming the first stitching seam to be carried out at the start of the stitching operation will then be described referring to FIGS. 6–10, using the conventional double chain stitch sewing machine or the covering chain stitch sewing machine, which employs, for instance, a couple of needles.

FIG. 6, is a schematic view of the generally well known double chain stitch or covering chain stitch sewing machine. As shown by this figure, when a pulley 24 of the sewing machine 1 is rotated by the motor through a belt, stitching needles 7 carry out a reciprocating movement while piercing through a cloth in response to the rotation of the pulley 24. Synchronously with this reciprocating movement, a looper 25 carries out an oscillating movement along an elliptic locus in a horizontal plane beneath the cloth. As shown by FIGS. 6 and 9, needle threads 26 are threaded through eyes of the stitching needles 7 while a looper thread 27 is inserted (has run) through the looper 25.

In the following paragraphs, a process for forming the first stitch at the start of the stitching operation will then be described in detail referring to FIGS. 7–10, using the conventional double chain stitch sewing machine or the covering chain stitch sewing machine, which employs, for instance, a couple of needles.

In FIG. 7, there is shown a mode of thread crossing between the stitching threads 26, indicated as black thread, and the looper thread 27, indicated as white thread. FIG. 7 is obtained at the time of forming a first stitching seam of the normal double chain stitch.

However, the usually intended crossing between the stitching threads and the looper thread can never be formed at the first stitch. At least one of the stitching threads at the first stitch will escape as indicated by the broken line, falling to form the seam; if the sewing machine is driven by the conventional sewing machine-driving apparatus, The above-stated process will be described in more detail referring to FIGS. 9 and 10, wherein FIG. 9(A) depicts a state of these components after the stitching needles 7 pause at a needle-up position and a thread cutting operation is performed. When the pulley 24 is rotated in the same direction as that of the normal stitching operation, the stitching needles 7 begin to move from this state to scoop or catch the looper thread 27 at the first stitch as shown by FIG. 9(B). The looper 25 retreats as indicated by a white arrow to a state shown by FIG. 9(C), and then the looper 25 advances again to scoop the needle threads 26 which form loops at a state shown by FIG. 9(D). Whne a state shown by FIG. 9(E) is reached, the looper 25 advances, the looper thread 27 begins to tighten the stitching thread 26. Then, at a second stitch depicted by FIG. 9(F), the looper thread 27 and the needle thread 26 engage with the looper 25, but the stitching needle 7*a* at the left side of the figure does not actually scoop the looper thread 27 and thus does not form a seam. On the other hand, the other stitching needle 7*b*, which is at the right side of the figure, solely scoops the looper thread 27. And hence, in this state of FIG. 9(F), a pseudo seam is formed which is different from the normal seam. The stated mode is schematically shown also in a plan view of FIG. 10, viewed from the upper side.

As has been described, the conventional double chain stitch or covering chain stitch sewing machine employing a couple of stitching needles cannot form an intended normal seam at the first stitch of the seaming start. Thus, in order to form the intended double chain stitch seam or covering chain stitch seam throughout the entire seaming line from the start, the conventional sewing machine requires much labor in additionally stitching the first stitch in double and has a problem of failing to make the finished product look good.

OBJECTS AND SUMMARY OF THE PRESENT INVENTION

The present invention intends to solve the above-mentioned problem inherent in the conventional apparatus, and has, as its object, a provision of a sewing machine-driving apparatus capable of forming an exactly intended double chain stitch seam or covering stitch seam at the very first stitch of the stitching start.

In accordance with the present invention, in the sewing machine-driving appararus for driving a sewing machine, which has a thread cutter means, a position detection device for detecting a needle position, a motor for driving the sewing machine and a control device for controlling said sewing machine and motor, said control device comprises;

a speed control unit, a position control unit, a thread cutting operation control unit and a stitch-start control unit; wherein said speed control unit controls rotating direction and rotating speed of said motor in response to a driving command by an operator or in response to the input of a reverse driving command, said position control unit controls the position of the needles of said sewing machine in response to a signal from said position detecting device issued at its stoppage in a manner that the needles may pause at a constant height, said thread cutting operation control unit actuates said thread cutter mechanism of said sewing machine in response to the input of a thread cutting command, said stitching start control unit comprises a reverse driving control unit, and said reverse driving control unit issues, in response to a driving command after the actuation of said thread cutter mechanism, a reverse driving command to said speed control unit in a manner that said motor drives said sewing machine in a direction reverse to that of a usual stitching operation until said position detection device detects a needle-down position.

Said reverse driving control unit may preferably be arranged to operate only when a driving command is issued after the actuation of said thread cutter mechanism, and said position detection device detects a needle-up position.

Said motor or said sewing machine may further comprise, a speed detection unit capable of generating a plurality of signals during one rotation thereof.

Said signals issued from said speed detection unit are to be counted by a counter provided in said reverse driving control device. Said counter senses the rotation angle of said motor by counting the signals issued from said speed detection unit using the signal issued from said position detection unit as a reference. Thus, said motor may be rotated to drive said sewing machine in a direction reverse to that of the usual stitching only for a previously determined angle.

Said sewing machine-driving apparatus may further comprise a delay circuit which permits the usual stitching operation of said sewing machine in accordance with said driving command, after a lapse of a predetermined time period after the reverse driving at the start of the stitching operation.

The sewing machine-driving apparatus built in accordance with the present invention is capable of 1) stopping the sewing machine at the needle-up position, and 2) rotating the motor in a direction reverse to that of the usual sewing operation in response to the step-down of the pedal for a limited time period between the completion of the thread cutting operation and a time point when the needles reach their needle-down position, thus 3) enabling the stitching needles to reach their lowest points without scooping the looper thread at the first stitch of the start of the stitching operation in the double chain stitch sewing machine or the covering chain stitch sewing machine.

Hence, the undesirable insufficient engagement between the stitching threads and the looper thread will not occur. In addition, the looper thread will not interfere with the stitching threads during the entire process of ascending from their lowest points in the subsequent forward rotation.

Therefore, the stitching needle can surely scoop the looper thread during the subsequent process of forming the first stitch when the stitching needles descend again. By doing so, the apparatus can form the intended seam at the first stitch at the start of the stitching operation.

While the novel features of the present invention are set forth particularly in the appended claims, the invention, both as to organization and content, will be better understood and appreciated, along other objects and features thereof, from the following detailed description taken in conjunction with the drawings.

BRIEF DESCRIPTION OF THE DRAWINGS

FIG. 9(A), FIG. 9(B), FIG. 9(C), FIG. 9(D), FIG. 9(E) and FIG. 9(F) are schematic views each representing the mode in a sequential process of forming the first stitch of the sewing start in the double chain stitch or covering chain stitch sewing machine when driving by the conventional sewing machine machine driving apparatus.

It will be recognized that some or all of the Figures are schematic representations for purposes of illustration and do not necessarily depict the actual relative sizes or locations of the elements shown.

DESCRIPTION OF THE PREFERRED EMBODIMENT

In the following paragraphs, a preferred embodiment of the present invention will be described with reference to the attached drawings, wherein the same reference symbols and numerals, as those used in above discussion made with reference to the conventional apparatus, are used for designating the same or similar components, and some of their descriptions are omitted here.

Figure 1:
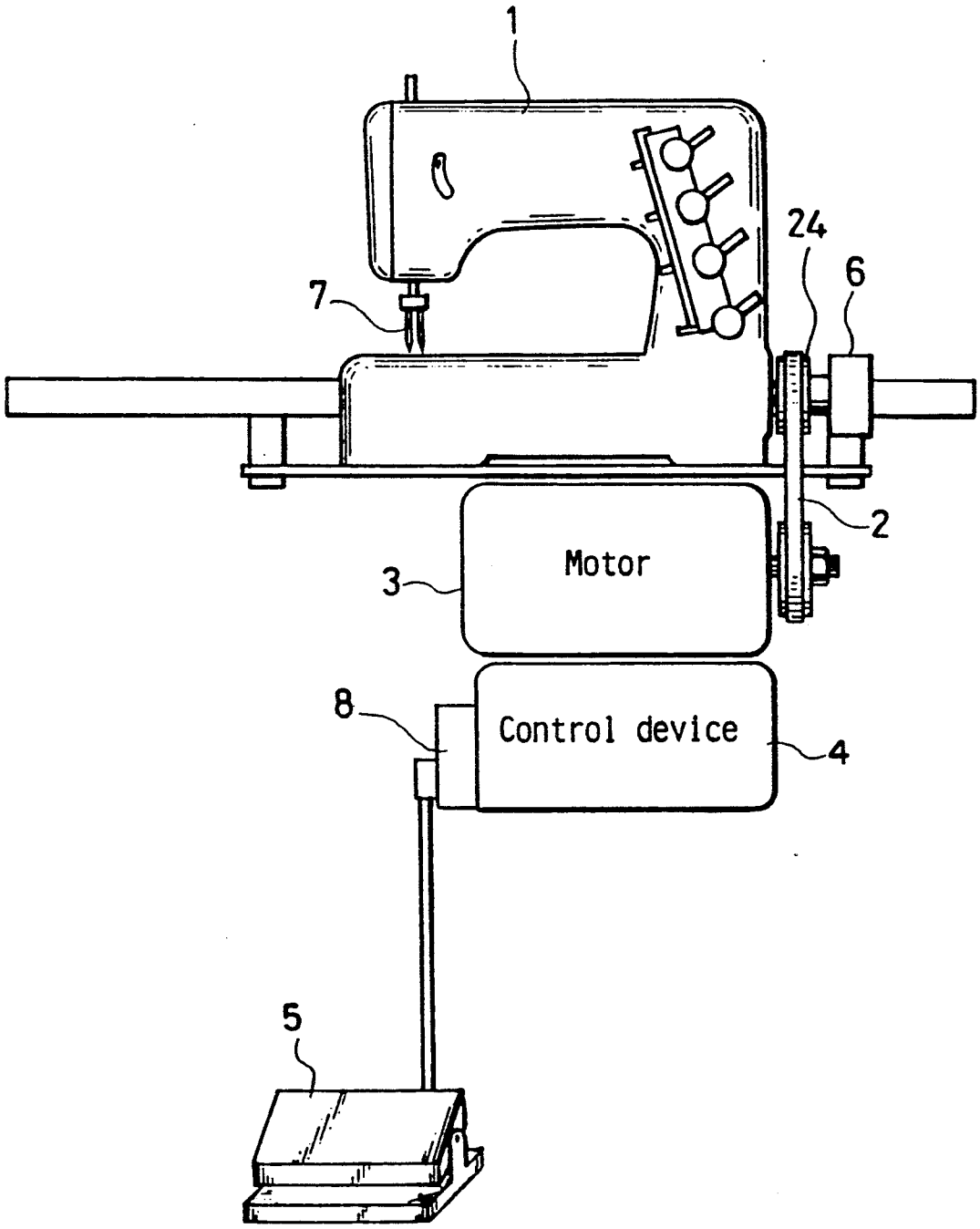
FIG. 1 is a schematic view showing a general arrangement of a sewing machine driving apparatus built in accordance with the present invention and a sewing machine.
Figure 2:
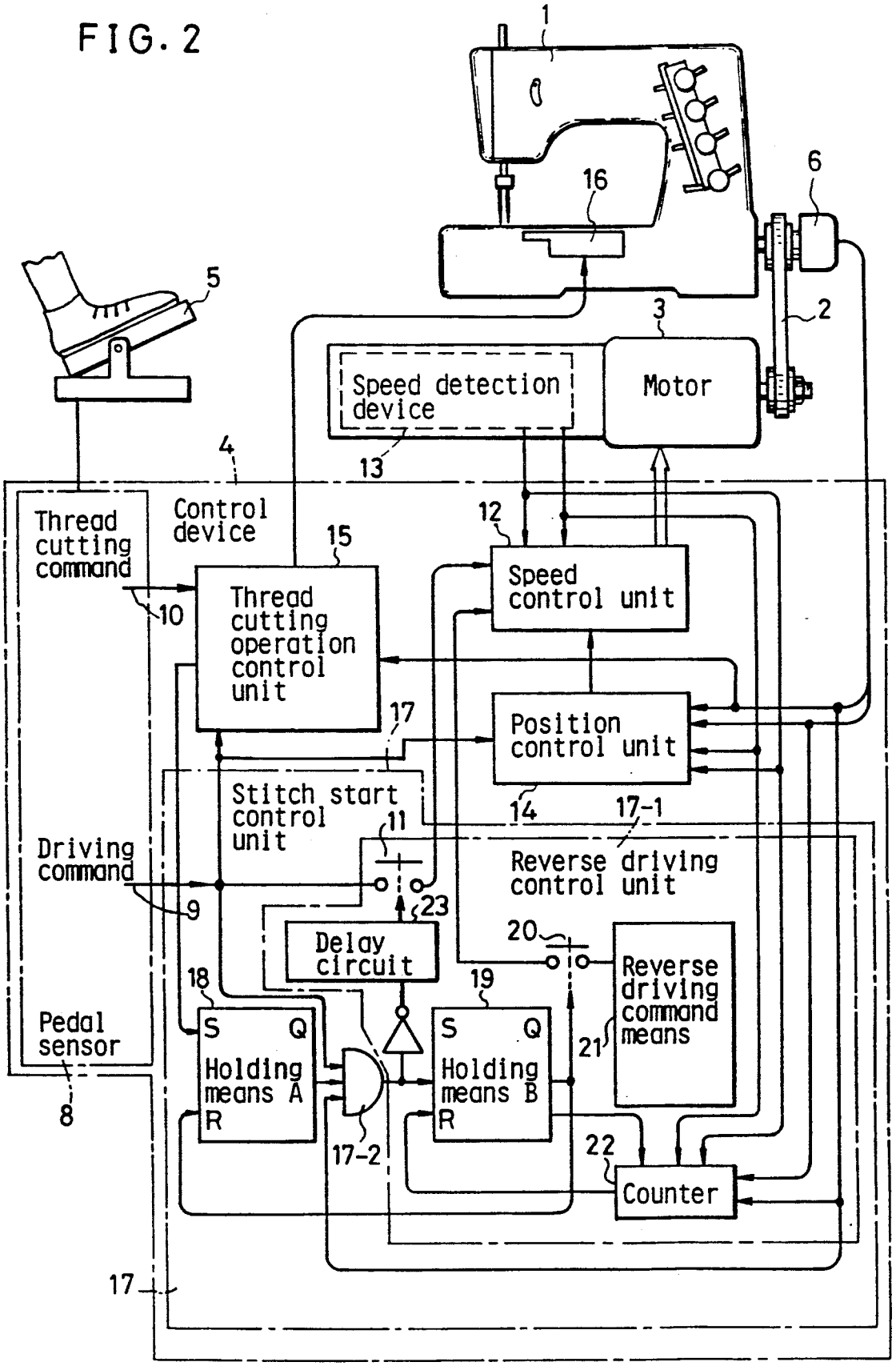
FIG. 2 is a block diagram of a sewing machine driving apparatus built in accordance with the present invention.

FIG. 1 is a schematic view showing a general arrangement of the sewing machine driving apparatus according to an embodiment of the present invention together with the sewing machine itself, FIG. 2 is a block diagram of the embodiment of the sewing machine driving apparatus. FIG. 3(A) through FIG. 3(F) are schematic views showing a relationship between movements of the stitching needles and that of the looper, when the double chain stitch or covering chain stitch sewing machine is driven by a sewing machine-driving apparatus of the embodiment of the present invention.

As shown in FIG. 1, the sewing machine 1, having the position detection device 6, is driven by the motor 3 through the belt 2. An operator carries out a stitching operation by operating the pedal 5 with his or her foot to actuate a control device 4 for controlling the motor 3. And the motor 3 drives the sewing machine 1 in response to the step-down operation of the pedal 5 and stops it when the pedal is returned to its neutral position. When the motor 3 is stopped, the control device serves to control the stitching needles 7 of the sewing machine in response to a signal issued from the position detection device 6 so that the needles 7 may always pause at a constant height.

Next, the operation of the control device 4, in particular, of the above-mentioned sewing machine-driving apparatus will be described with reference to FIG. 2.

In addition to the components already discussed with reference to the explanation of the control device 28 in the conventional driving apparatus, the control device 4 includes a stitch start control unit 17 composed of a reverse driving control unit 17-1 coupled with a first holding means 18 through and AND gate 17-2. The reverse driving control unit 17-1 includes a first change-over control means 11, a second holding means 19, a second change-over control means 20, a reverse driving command means 21, a counter 22 and a delay circuit 23.

The operation of the pedal 5 by the operator is sensed by the pedal sensor 8 which generates the driving command 9 and the thread-cutting command 10. When the operator steps down on the pedal 5 with his or her toe, the driving command 9 is issued. The driving command 9 is interrupted in response to the returning operation of the pedal 5 back to its neutral position. If the operator steps down on the pedal 5 with his or her heel, the thread-cutting command 10 is issued, but it is likewise interrupted in response to the returning operation of the pedal 5 back to its neutral position.

The driving command 9 is transmitted to the speed control unit 12 through the normally-closed first change-over control means 11. The speed control unit 12 commands the motor 3 to rotate at a speed in proportion to the depth of the pedal step-down. The speed control unit 12 also monitors a signal issued from the speed detection device 13 provided on the motor 3, and controls the rotation speed and the direction of the motor, 3. The motor employed in this embodiment is a DC brushless motor and the speed detection unit 13 issues two signals of 360 pulses/one rotation and of A and B phases offset each other by 90°, respectively.

When the pedal 5 is returned to its neutral position and the driving command 9 is interrupted, the position control unit 14 issues a command for reducing the speed of the motor 3 while monitoring a signal issued from the speed detection device 13, and controls the speed control unit 12 so that the sewing machine 1 may stop at positions where the stitching needles 7 pause at either one of their needle-up or needle-down position.

The thread cutting command 10 is fed to the thread cutting operation control unit 15. The thread cutting operation command 10 actuates the thread cutter mechanism 16 in the sewing machine by a known interior sequential control means (omitted from the illustration) under the conditions that the sewing operation is over and the needles are paused.

When the thread cutting operation control unit 15 operates, the first holding means 18 in a stitching start control unit 17 is set. Immediately after the first holding means 18 is set, the position detection device 6 issues a signal which indicates that the stitching needles are at their needle-up positions and the driving command 9 is issued, and the first change-over means 11 shifts to its open state by virtue of the AND gate 17-2.

Because of the above-mentioned arrangement, the motor 3 will not be driven by the driving command 9 at that time and, simultaneously, the second holding means 19 is set instead. The output of the second holding means 19 shifts the second change-over means 20 to its closed state and transfers a command of the reverse driving command means 21 to the speed control unit 12. The reverse driving command means 21 issues a command to the speed control unit 12 which permits the motor to rotate at a predetermined speed in a direction reverse to that indicated by the driving command 9. When the speed control unit 12 starts to rotate the motor 3, the counter 22 begins to count the signals issued from the speed detection device 13 using the signal from the position detection device 6 as a reference, and, when the counted value reaches a predetermined value, it resets the second holding means 19.

In this embodiment, the speed control unit 12 is arranged to reset the second holding means 19 at an angular position by 15° rotation of the pulley 24 after the detection of the needle-down position.

When the second holding means 19 is reset, it shifts the second change-over means 20 to its open state and simultaneously, resets the counter 22 and the first holding means 18. When the first holding means 18 is reset, the first change-over means 11 is also closed after a lapse of a certain time period, which is given for retardation or stoppage by a delay circuit 23. When the first change-over means 11 is closed, the driving command 9 is transmitted to the speed control unit 12 permitting the sewing machine to perform its usual driving/stopping.

As previously described, by employing the stated sewing machine-driving apparatus, the double chain stitch or covering chain stitch sewing machine with, for instance, a couple of stitching needles, is made to form an intended seam from the very first stitching.

Figure 6:
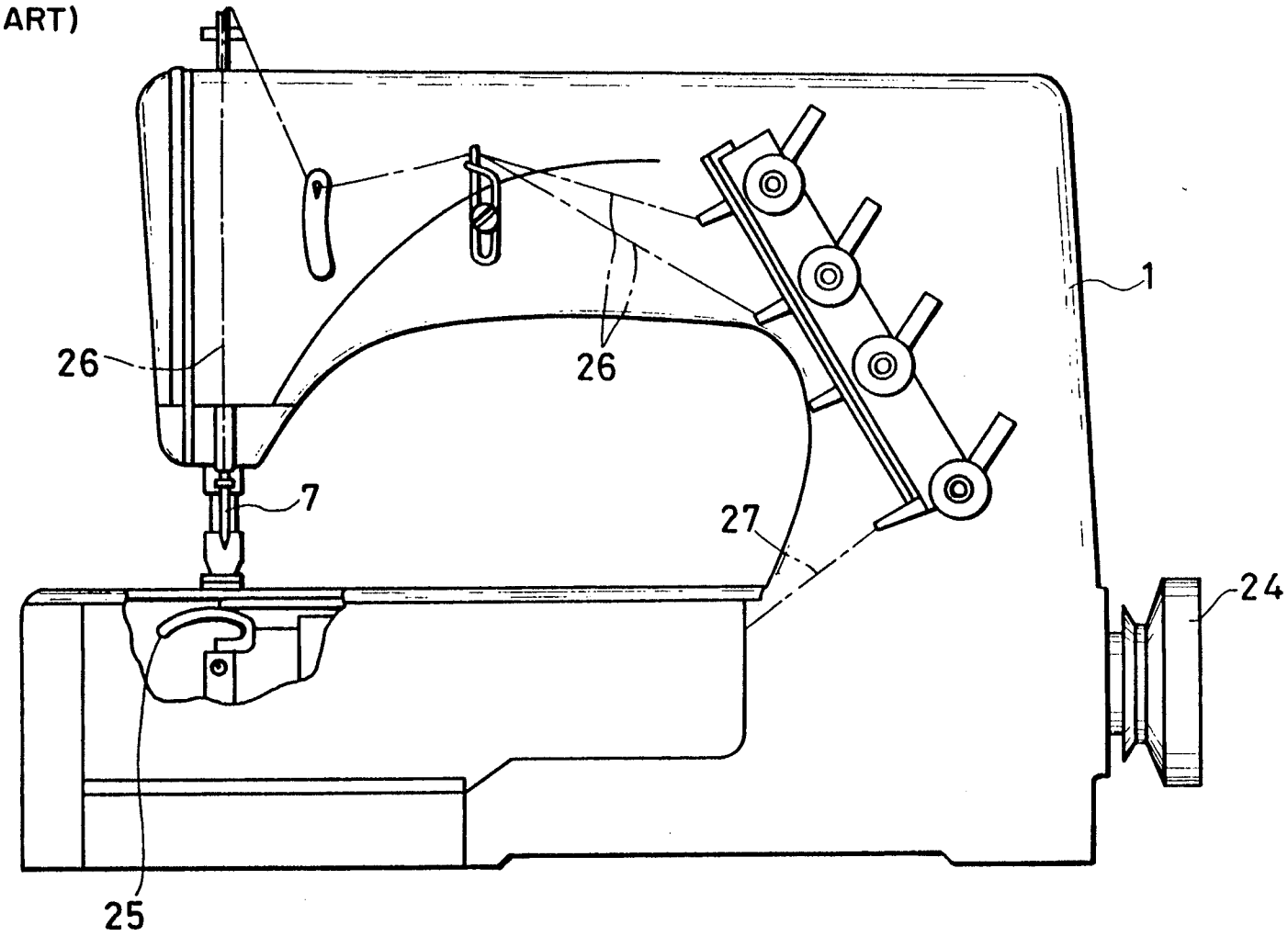
FIG. 6 (PRIOR ART)
FIG. 6 is the partly-cut out schematic side view illustrating an example of the conventional double chain stitch or covering chain stitch sewing machine.
Figure 7:
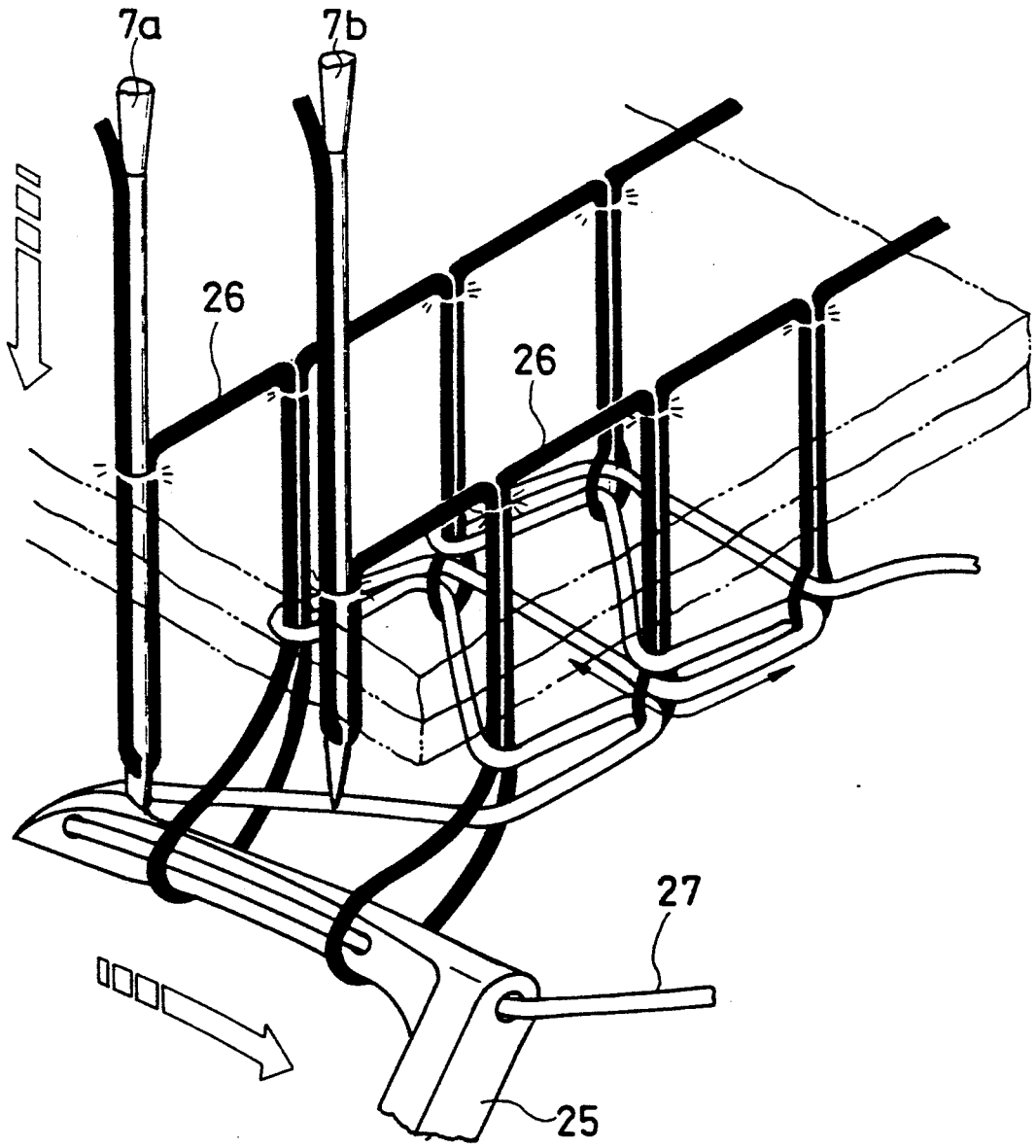
FIG. 7 (PRIOR ART)
FIG. 7 is the schematic view showing the normal seam to be formed by the conventional double chain stitch or covering chain stitch sewing machine.
Figure 8:
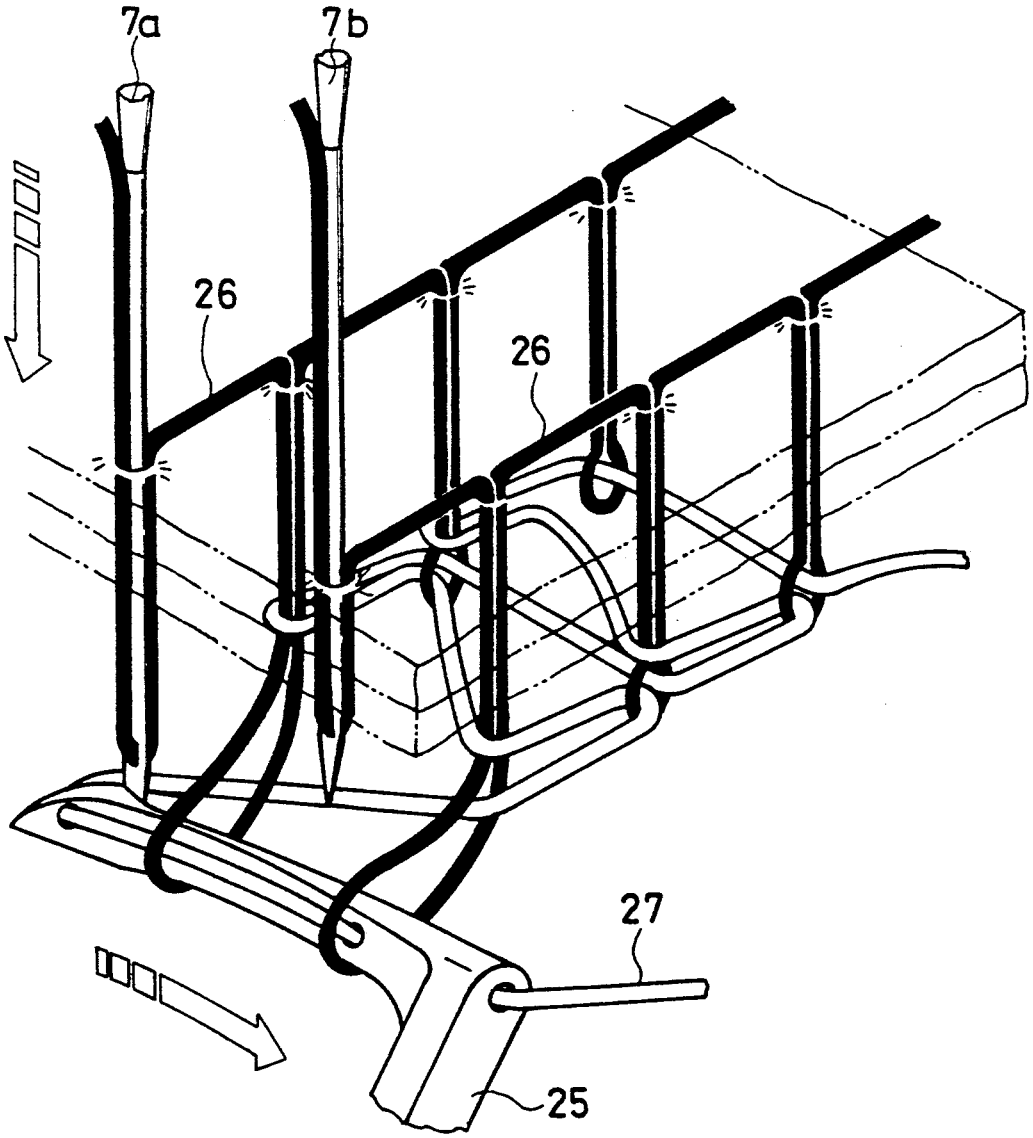
FIG. 8 (PRIOR ART)
FIG. 8 is the schematic view showing a conventional double seam.
Figure 10:
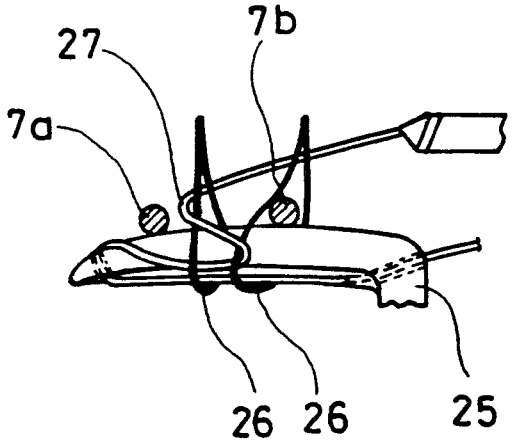
FIG. 10 (PRIOR ART)
FIG. 10 is the plan view of FIG. 9(F).

Next, a detailed procedure for forming the first stitching seam will be described by referring to FIG. 3 and FIG. 6.

Since the sewing machine actually used with the exemplified sewing machine-driving apparatus is identical to the conventional one in its appearance, it will be described by referring to FIG. 6, which is a schematic view of the generally known double chain stitch or covering chain stitch sewing machine.

Figure 3A:
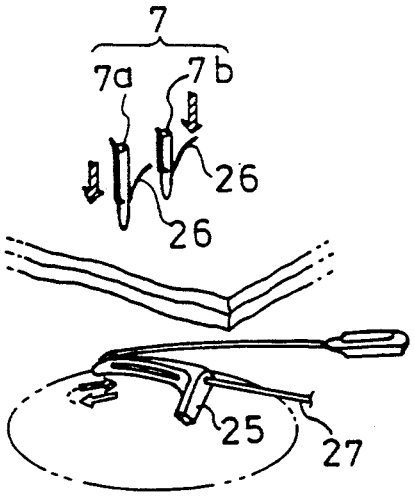
FIG. 3(A), FIG. 3(B), FIG. 3(C), FIG. 3(D), FIG. 3(E) and FIG. 3(F) are schematic views each representing a mode in a sequential process of forming the first stitch of the sewing start in the double chain stitch or covering chain stitch sewing machine when driven by a sewing machine machine driving apparatus built in accordance with the present invention.

FIG. 3(A) indicates a state of the essential components just after the thread cutting operation when the stitching needles 7 are paused at their needle-up positions.

Figure 3B:
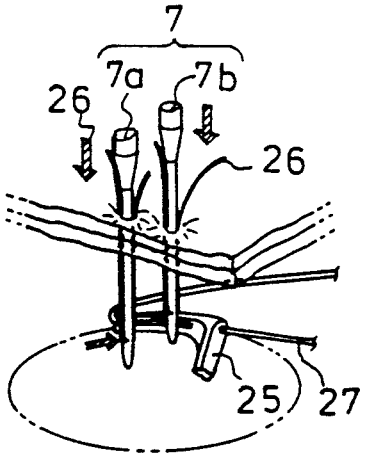
Figure 3C:
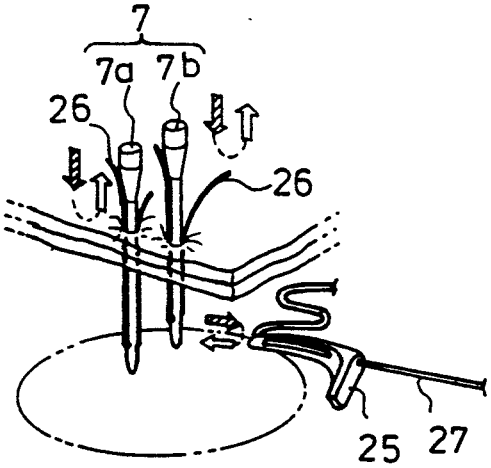
Figure 3D:
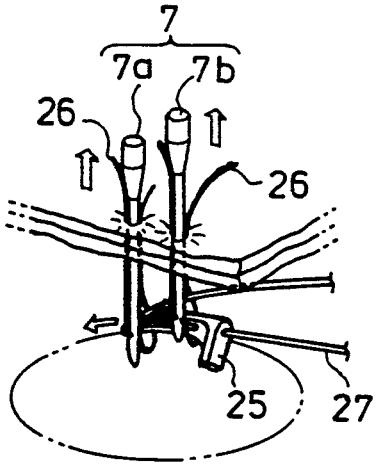
Figure 3E:
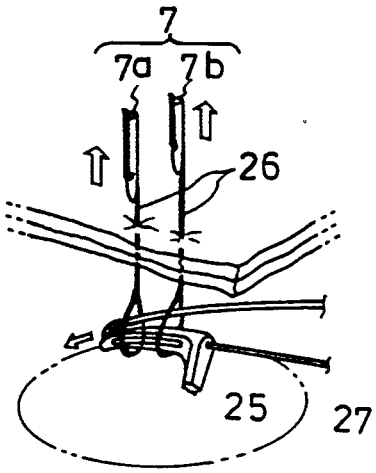
Figure 3F:
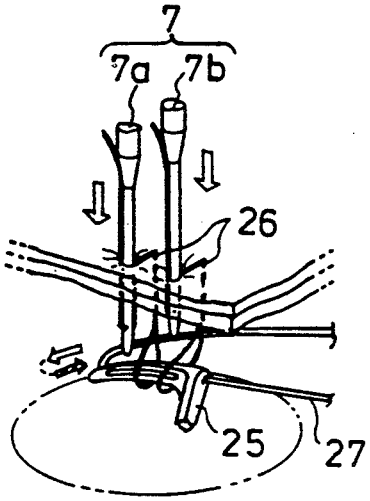
Figure 4:
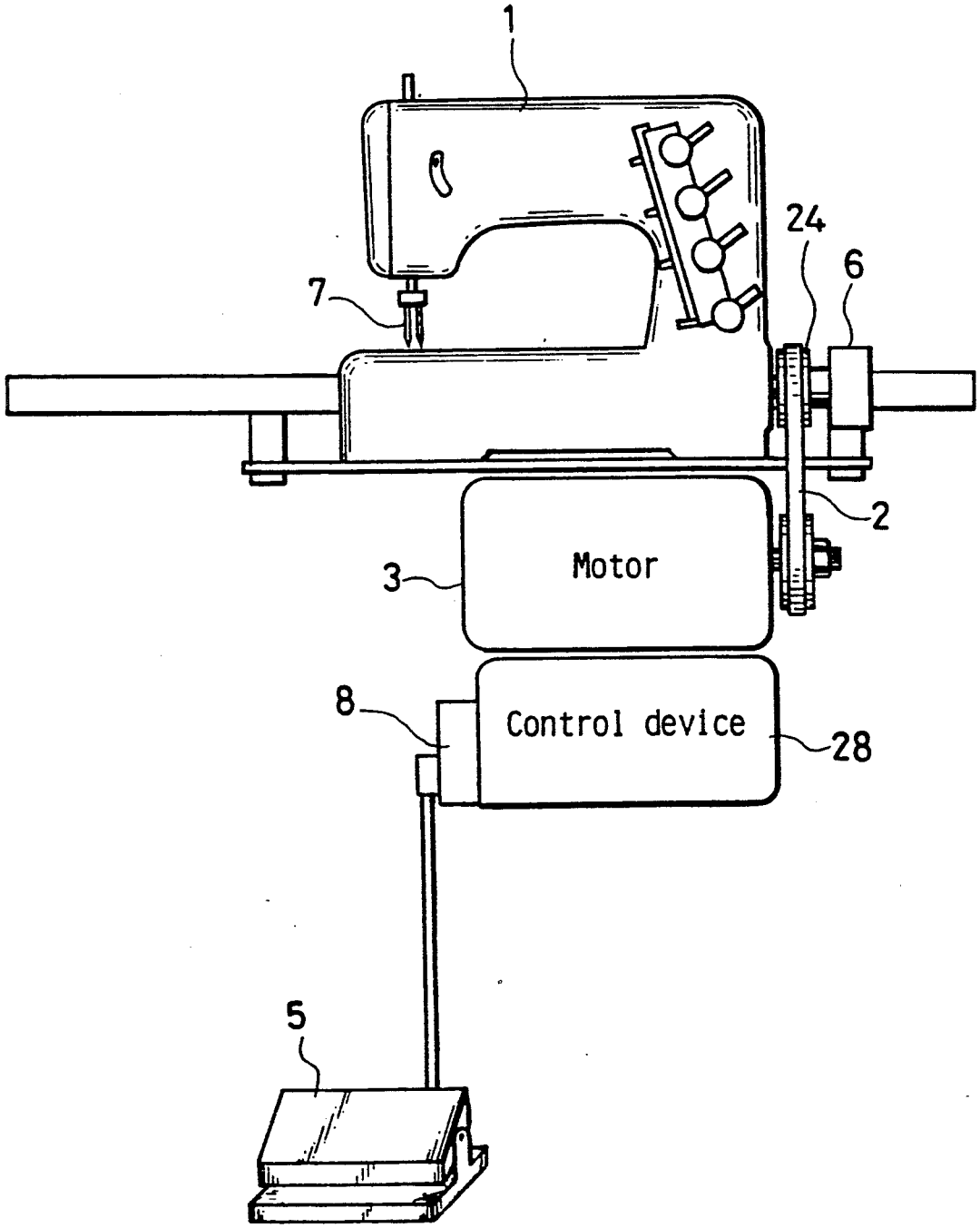
FIG. 4 (Prior Art)
FIG. 4 is a schematic view showing a general arrangement of the conventional sewing machine driving apparatus and a sewing machine.
Figure 5:
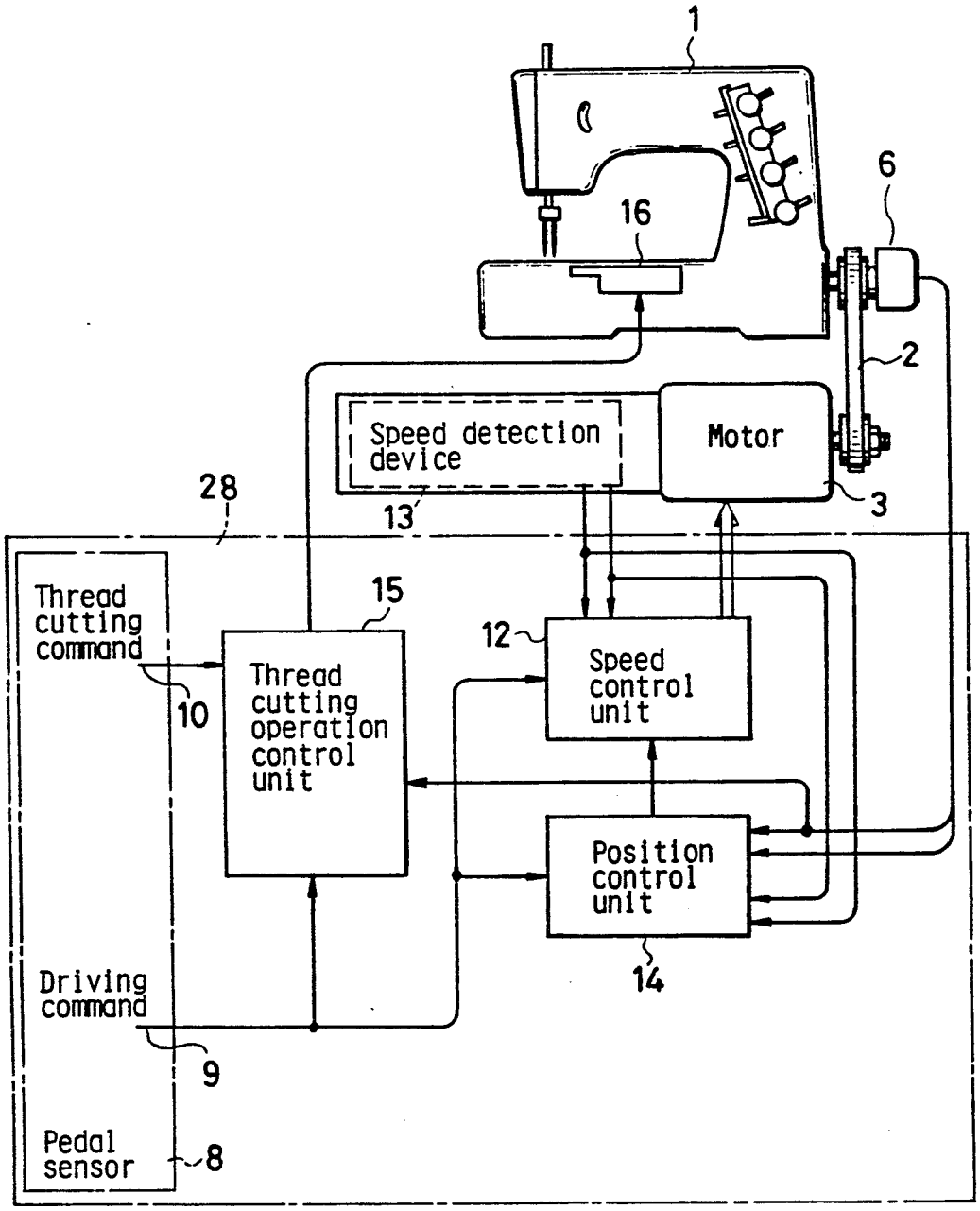
FIG.5(Prior Art)
FIG. 5 is a block diagram of the conventional sewing machine driving apparatus.

When a pulley 24 of the sewing machine 1 is rotated in a direction reverse to that of the usual sewing operation, the stitching needles 7 descend from the state shown by FIG. 3(A), passing aside the looper 25 along a path at the reverse side (front side of the paper) as indicated by solid black arrows in FIG. 3(B), and do not scoop the looper thread 27. Then, at the needle-down position shown in FIG. 3(C), the pulley 24 returns to rotate in the usual direction, causing the looper 25 and the looper thread 27 to move as indicated by white arrows. In a state indicated by FIG. 3(D), the looper 25 scoops the needle thread 26, and the operation proceeds to complete the first stitch as shown by FIG. 3(E) without making the looper thread 27 cross the as shown by FIG. 3(E) threads 26 as shown by FIG. 3(E). This mode is more clearly appreciated if it is compared with the case of formation of undesirable pseudo stitch shown in FIG. 9(E) discussed with reference to the conventional apparatus. That is, contrary to the pseudo or inaccurate seam formed in the first stitch in the conventional apparatus of the case of FIG. 9(E), the stitching by the present invention apparatus forms an accurate seam from the start of seaming. That is, in the second stitch, the stitching needle 7*a* surely scoops the looper thread 27, as shown by FIG. 3(F), thus making the intended stable and accurate seam formed from the start of the resultant seam of the stitching operation.

Although the counter 22 of the embodiment is set to count the signals which are equivalent to the rotation angle of 15° of the pulley, a similar advantage will be obtained if the needle-up position or any other value including "0" is taken as reference, or the counter 22 is totally omitted.

In addition to this, the delay circuit 23 may likewise be omitted. Further, although the second holding means 19 of this embodiment is set by the driving command 9 at the time the first holding means 18 is set and, at the same time, the position detection device 6 issues the needle-up signal, the condition of "the time when the position detection device 6 issues the needle-up signal" may be omitted.

Although the present invention has been described in its perferred form with a certain degree of particularity, it is understood that the present disclosure of the preferred form may be changed in the details of construction and the combination and arrangement of parts and components without changing the spirit and the scope of the invention as hereinafter claimed.

What is claimed is:

1. A sewing machine-driving apparatus for driving a sewing machine having needles, a thread cutter means, a position detecting device for detecting a needle position, and a motor for driving the sewing machine, said sewing machine-driving apparatus comprising:

a speed control unit for controlling a rotating direction and rotating speed of said motor in response to one of a driving command from an operator and a reverse driving command, a position control unit for controlling a position of said needles of said sewing machine in response to a signal from said position detecting device issued at a first predetermined needles position to stop said needles at a constant height, a thread cutting operation control unit for actuating said thread cutter means of said sewing machine in response to a thread cutting command, a stitch start control unit for controlling the driving direction of said motor and having a reverse driving control unit, said reverse driving control unit issuing, in response to a driving command after the actuation of said thread cutter means, a reverse driving command to said speed control unit for driving said motor to drive said sewing machine in a direction reverse to that of a usual stitching operation until said position detecting device detects a second predetermined needles position.

2. The sewing machine-driving apparatus as claimed in claim 1, wherein said reverse driving control unit is arranged to operate only when a driving command is issued after an actuation of said thread cutter means, and said position detection device detects a needle-up position.

3. The sewing machine-driving apparatus as claimed in claim 1, wherein;

a speed detection device capable of generating a plurality of signals during one rotation thereof is included in said motor of said sewing machine, a counter for counting the signals issued from said speed detection device is included in said reverse driving control unit, said counter senses a rotation angle of said motor by counting the signals issued from said speed detection device using the signal issued from said position detecting device as a reference, and said second predetermined needles position is a predetermined rotation angle.

4. The sewing machine-driving apparatus as claimed in claim 1, further comprising a delay circuit for permitting the usual stitching operation of said sewing machine in accordance with said driving command, after a lapse of a predetermined time period after said sewing machine is driven in a reverse direction.

5. A sewing machine driving apparatus as claimed in claim 1, wherein said second predetermined needles position is a needles down position.

6. A sewing machine-driving apparatus for driving a sewing machine comprising:

needles, a thread cutter means for cutting thread, a position detecting device for detecting a needle position, a motor for driving the sewing machine, a speed control unit for controlling a rotating direction and rotating speed of said motor in response to one of a driving command from an operator and a reverse driving command, a position control unit for controlling a position of said needles of said sewing machine in response to a signal from said position detecting device issued at a first predetermined needles position to stop said needles at a constant height, a thread cutting operation control unit for actuating said thread cutter means of said sewing machine in response to a thread cutting command, a stitch start control unit for controlling the driving direction of said motor and having a reverse driving control unit, said reverse driving control unit issuing, in response to a driving command after the actuation of said thread cutter means, a reverse driving command to said speed control unit for driving said motor to drive said sewing machine in a direction reverse to that of a usual stitching operation until said position detecting device detects a second perdetermined needles position.

* * * * *